US006305356B1

(12) United States Patent
Faix et al.

(10) Patent No.: US 6,305,356 B1
(45) Date of Patent: Oct. 23, 2001

(54) COMMON RAIL SYSTEM

(75) Inventors: Erhard Faix, Gaertringen; Gerd Loesch, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/479,733

(22) Filed: Jan. 7, 2000

(30) Foreign Application Priority Data

Jan. 9, 1999 (DE) ..... 199 00 562

(51) Int. Cl.[7] ..... F02M 37/04; F15D 1/14

(52) U.S. Cl. ..... 123/495; 137/504; 138/43; 138/46

(58) Field of Search ..... 123/495; 137/503, 137/504; 138/43, 46

(56) References Cited

U.S. PATENT DOCUMENTS 2,678,066 * 5/1954 Carter ..... 138/45
2,939,487 * 6/1960 Fraser et al. ..... 138/45
3,130,747 * 4/1964 Benaway ..... 137/504
3,872,884 * 3/1975 Busdiecker et al. ..... 137/498
4,198,948 * 4/1980 Conrad et al. ..... 123/495 X
4,383,552 * 5/1983 Baker ..... 138/46
5,469,883 * 11/1995 Lee ..... 137/513.3
5,701,872 * 12/1997 Kaku et al. ..... 123/495
6,021,761 * 2/2000 Kellner et al. ..... 123/495

* cited by examiner

*Primary Examiner*—John Rivell
(74) *Attorney, Agent, or Firm*—Ronald E. Greigg; Edwin E. Greigg

(57) ABSTRACT

A common rail system having a regulated prefeed pump, which pumps a fuel flow from a fuel tank to a high-pressure pump. The fuel flow is split with the aid of a valve assembly into a lubricant flow and a high-pressure feed flow that is pumped into a high-pressure reservoir, and acted upon by high pressure. The prefeed pump has a substantially linear characteristic feed curve with a certain slope. To improve the regulating performance, the valve assembly for the lubricant flow includes a valve whose characteristic feed curve initially rises in a first portion (I) with the rpm of the prefeed pump with the same slope as the characteristic feed curve of the prefeed pump. Then in a second portion (II) rises substantially linearly, with a lesser slope than the characteristic feed curve of the prefeed pump, and in a third portion (III) finally drops again.

10 Claims, 1 Drawing Sheet

COMMON RAIL SYSTEM

BACKGROUND OF THE INVENTION

The invention relates to a common rail system having a regulated prefeed pump, which pumps a fuel flow from a fuel tank to a high-pressure pump, the fuel flow being split with the aid of a valve assembly into a lubricant flow and a high-pressure feed flow that is pumped, acted upon by high pressure, into a high-pressure reservoir, and the prefeed pump has a substantially linear characteristic feed curve with a certain slope.

To improve the efficiency of common rail systems, it is necessary to establish an equilibrium in the pressure reservoir (rail) between the inflowing and outflowing fuel flow. The attempt is made to do this by on-demand quantity regulation. One such common rail system is described for instance in German Patent Disclosure DE 197 39 653, which had not been published before the priority date of the present application. To keep the lubricant flow constant, a flow regulating valve is used.

The high-pressure pump is driven via the engine. Thus, the rpm of the high-pressure pump is dependent on the engine rpm. In experiments in the context of the present invention, it has been found that the known flow regulating valve, while it does have good regulating performance in the upper rpm range, it does not perform well in the lower rpm range.

OBJECT AND SUMMARY OF THE INVENTION

An object of the invention is to furnish a common rail system of the type described at the outset that has improved regulating performance, especially at low rpm.

This object is attained, in a common rail system having a regulated prefeed pump, which pumps a fuel flow from a fuel tank to a high-pressure pump. The fuel flow is split with the aid of a valve assembly into a lubricant flow and a high-pressure feed flow that is pumped, into a high-pressure reservoir, and acted upon by high pressure. The prefeed pump has a substantially linear characteristic feed curve with a certain slope, in that for the lubricant flow, the valve assembly includes a valve whose characteristic feed curve initially rises in a first portion with the rpm of the prefeed pump with the same slope as the characteristic feed curve of the prefeed pump. Then in a second portion has a substantially linear course with a lesser slope than the characteristic feed curve of the prefeed pump, and in a third portion finally drops again. In the first portion, practically all the fuel flow furnished by the prefeed pump is diverted as a lubricant flow. In the second portion, the high-pressure feed flow slowly increases. In the third portion, the lubricant flow drops to a minimum that still assures adequate lubrication. This considerably improves the feed quantity characteristic at low engine rpm.

One particular kind of embodiment of the invention is characterized in that the lubricant flow valve has a flow cross section that is variable between an opened and a closed valve position. That in the opened position, the flow cross section is so large that a sufficiently large lubricant flow can pass through and then decreases as a function of the pilot pressure as soon as the valve begins to close. By means of the flow cross section that is variable as a function of the pilot pressure furnished by the prefeed pump, the lubricant flow initially rises and then drops again.

Another particular type of embodiment of the invention is characterized in that the lubricant flow valve includes a valve body with a through bore, in which a valve piston prestressed by a spring is movable back and forth. This valve is especially simple in design and especially economical to make. As the piston stroke increases, the flow area decreases. The regulating performance of the lubricant flow valve can be varied by way of the magnitude of the spring constant.

Another particular kind of embodiment of the invention is characterized in that the piston takes the form of a hollow cylinder, which in the closed valve position contacts one end of a tang, in which a longitudinal bore is installed. The longitudinal bore is disposed concentric with the valve piston, and in the opened valve position is spaced apart from one end of the tang. A transverse bore is installed in the tang and communicates with the longitudinal bore and, in the opened valve position, communicates also with the interior of the valve piston. By the use of this lubricant flow valve, it is possible to dispense with the known flow regulating valve. In experiments with the lubricant flow valve according to the invention, a considerably improved regulating performance at low engine rpm has been demonstrated.

Another particular kind of embodiment of the invention is characterized in that the diameter of the longitudinal bore in the tang is smaller than the inside diameter of the valve piston. In the closed valve position, the longitudinal bore of the tang acts as a throttle.

Further advantages, characteristics and details of the invention will become apparent from the ensuing description, in which an exemplary embodiment of the invention is described in detail in conjunction with the drawing. The characteristics recited in the claims and mentioned in the description can each be essential to the invention individually or in an arbitrary combination.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
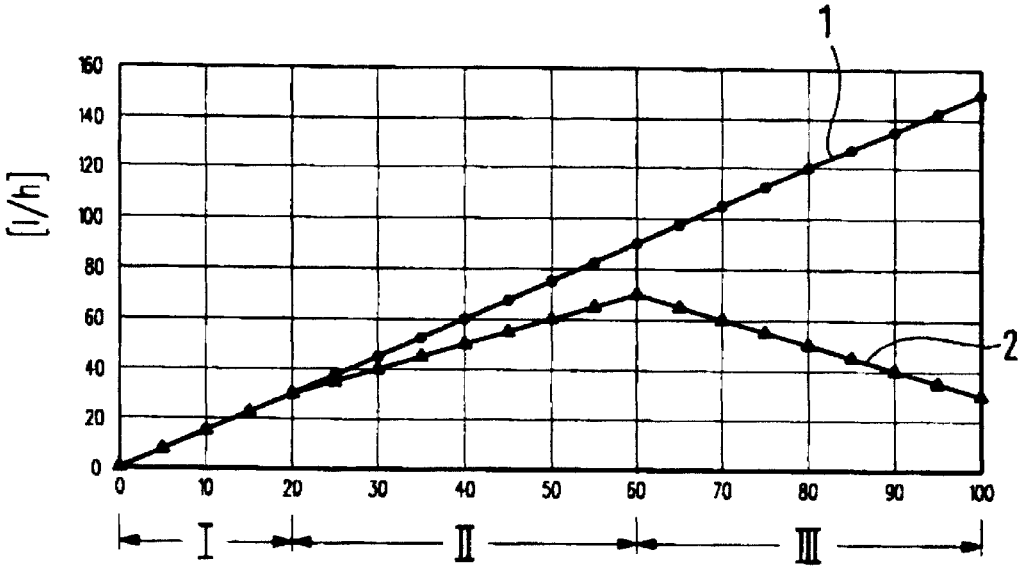
FIG. 1 is a graph plotting various characteristic feed curves over the rpm.

In FIG. 1, in a coordinate system, the quantity is plotted over the rpm in the form of characteristic curves 1 and 2. Characteristic curve 1 shows the feed performance of the prefeed pump over the rpm. Characteristic curve 2 represents the lubricant flow pumped through the lubricating valve over the rpm.

As seen in FIG. 1, the characteristic curve 1 has a linear course. That is, the higher the rpm of the prefeed pump, the more fuel is pumped. The characteristic curve 2 is also linear, but with different slopes, in portions I, II and III. In portion I, the characteristic curve 2 has the same slope as the characteristic curve 1 of the prefeed pump. This means that in portion I all the fuel quantity furnished by the prefeed pump is used for lubrication. In portion II, the characteristic curve 2 has a somewhat lesser slope than the characteristic curve 1. This means that in portion II, fuel is delivered in increasing amounts to the high-pressure pump, where it is acted upon by high pressure. In portion III, the characteristic curve 2 drops slightly. That is, as the rpm increases, the lubricant flow drops to a minimum value. This minimum value is selected such that adequate lubrication of the high-pressure pump is assured. In portion III, the fuel quantity pumped to the high-pressure pump increases with the rpm more markedly than in portion II.

Figure 2:
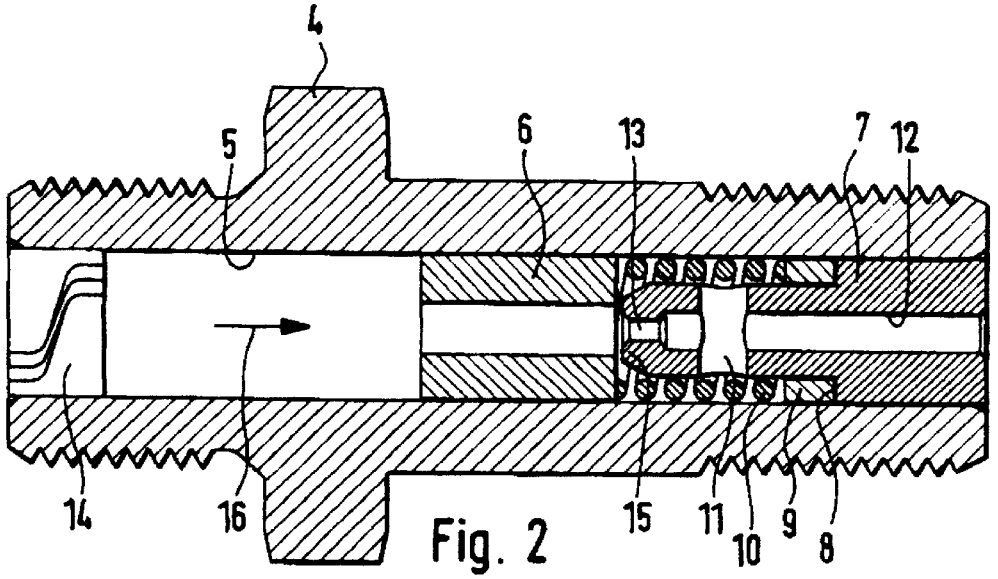
FIG. 2 shows a lubricant flow valve according to the present invention.

In FIG. 2, a longitudinal section through a lubricant flow valve according to the present invention is shown. The lubricant flow valve has an elongated valve body 4, in which a through bore 5 is made. A valve piston 6 is displaceably received in the through bore 5. The valve piston 6 takes the form of a hollow cylinder.

A tang 7 is pressed flush into the end of the valve body 4 located on the right in FIG. 2. The tang 7 substantially takes the form of a cylinder with a shoulder 8 extending all the way around. The shoulder 8 forms a bearing face for an adjusting shim 9. The adjusting shim 9 in turn forms a stop for a spring 10. A transverse bore 11 is also made in the tang 7, in the region of the spring 10. The transverse bore 11 communicates with a longitudinal bore 12 in the tang 7. The longitudinal bore 12, on an end oriented toward the valve piston 6, has a region 13 of reduced diameter. This region 13 serves as a throttle.

On the end of the tang 7 oriented toward the piston 6, a valve seat 15 is formed. When fuel flows through the through bore 5 in the direction of the arrow 16, the valve piston 6 is pressed against the spring 10. As long as the compressive force acting on the valve piston 6 is less than the force of the spring 10, the valve piston 6 is in an opened position. In the opened position, fuel can flow past the valve seat 15 into the longitudinal bore 12 of the tang 7 via the transverse bore 11. At the same time, fuel can flow through the throttle 13 to reach the longitudinal bore 12 of the tang 7.

As soon as the compressive force acting on the valve piston 6 becomes greater than the force of the spring 10, the flow cross section between the valve piston 6 and the valve seat 15 begins to change. The flow cross section keeps changing until the valve piston 6 comes to rest on the valve seat 15. From that moment on, the fuel now passes only through the throttle 13 into the longitudinal bore 12 of the tang 7.

By means of a securing ring 14, which is inserted into the valve body 4 on the end of the through bore 5 opposite the tang 7, the piston is prevented from slipping out of the through bore 5. At the same time, the securing ring 14 forms a stop for the valve piston 6.

The foregoing relates to a preferred exemplary embodiment of the invention, it being understood that other variants and embodiments thereof are possible within the spirit and scope of the invention, the latter being defined by the appended claims.

We claim:

1. In a common rail system having a regulated prefeed pump, said pump pumps a fuel flow from a fuel tank to a high-pressure pump, wherein the fuel flow is split into a lubricant flow and a high-pressure feed flow that is pumped into a high-pressure reservoir and acted upon by high pressure, the prefeed pump has a substantially linear characteristic feed curve (1) with a certain slope, and the lubricant flow is controlled by a lubricant flow valve assembly, the improvement comprising:

the lubricant flow valve assembly a valve whose characteristic feed curve (2) initially rises in a first portion (I) with the rpm of the prefeed pump with the same slope as the characteristic feed curve (1) of the prefeed pump, and then in a second portion (II) rises substantially linearly, with a lesser slope than the characteristic feed curve (1) of the prefeed pump, and in a third portion (III) finally drops again.

2. The improvement for a common rail system according to claim 1, in which the lubricant flow valve assembly has a flow cross section that is variable between an opened and a closed valve position and in the opened position is so large that a sufficiently large lubricant flow can pass through and that decreases as a function of a pilot pressure as soon as the valve begins to close.

3. The improvement for a common rail system according to claim 2, in which the lubricant flow valve assembly includes a valve body (4) with a through bore (5), in which a valve piston (6) prestressed by a spring (10) is movable back and forth.

4. The improvement for a common rail system according to claim 3, in which the piston (6) takes the form of a hollow cylinder, which in the closed valve position contacts one end of a tang (7), in which a longitudinal bore (12) is installed, said longitudinal bore is disposed concentric with the valve piston (6), and in the opened valve position the valve piston is spaced apart from this one end of the tang (7), and a transverse bore (11) is formed in the tang (7) and communicates with the longitudinal bore (12) and, in the opened valve position, the transverse bore communicates with the interior of the valve piston (6).

5. The improvement for a common rail system according to claim 4, in which the diameter of the longitudinal bore (12) in the tang (7) is smaller than the inside diameter of the valve piston (6).

6. A flow regulating valve for use in a common rail fuel system to maintain a substantially constant flow of fuel to be used as a lubricant, said regulating valve comprising an elongated valve body (4) having a bore (5) of the valve body with a constant diameter throughout its length, the bore having inserted therein a valve piston (6) which is displaceable along the bore (5) of the valve body, and a tang (7) fixedly mounted in the bore, such that one end of the tang (7) is flush with one end of the valve body (4), the tang (7) being divided into two sections by a shoulder (8), one of said sections having a diameter which is press fit into the bore, the other section having a smaller diameter so as to receive a spring (10) positioned within the bore (5) of the valve body between the shoulder (8) and the valve piston (6), which spring (10) biases the valve piston (6) away from the tang (7), the tang having a longitudinal bore (12), and the smaller diameter section having a transverse bore (11) which communicates between the longitudinal bore and the outside of the smaller diameter section of the tang (7), the smaller diameter section also having an end with a valve seat (15) and a restricted region (13), wherein the restricted region (13) of the longitudinal bore (12) of the tang has a smaller flow path compared to the rest of the longitudinal bore (12) of the tang, and the valve piston (6) has a longitudinal bore, such that as fuel is pumped into the other end of the bore (5) of the valve body, fuel can flow through the bore (5) of the valve body, the longitudinal bore of the valve piston (6), the restricted region (13) and the longitudinal bore (12) of the tang (7), and an additional portion of fuel will flow through the bore (5) of the valve body, the longitudinal bore of the valve piston (6), around the outside of the smaller diameter section of the tang (7), through the transverse bore (11) and the longitudinal bore (12) of the tang (7), such that if the fuel flow increases to a sufficient amount, the increased flow of the fuel moves the valve piston (6) against the pressure of the spring (10) into engagement with the valve seat (15) so as to block fuel from flowing past the outside of the smaller diameter section of the tang (7) and all of the fuel must flow through the restricted region (13).

7. A flow regulating valve such as recited in claim 6, wherein there is also provided a securing ring (14) positioned in the bore (5) of the valve body, which securing ring (14) maintains the valve piston (6) within the bore (5) of the valve body.

8. A flow regulating valve such as recited in claim 6, wherein there is also provided an adjusting shim (9) adjacent the shoulder (8) of the tang (7), which provides means to set a different spring force for the spring (10).

9. A method of supplying a high pressure pump with a supply of fuel from a prefeed pump, said supply fuel being at least partially used in the high pressure pump as a lubricating medium, the method comprising:

providing the fuel from the prefeed pump with a substantially linear characteristic feed curve (1) having a certain slope, supplying the lubricant flow to the high pressure pump with a feed curve (2) which initially rises in a first portion (I) with the same slope as the characteristic feed curve (1), then in a second portion (II) rises substantially linearly, but with a lesser slope than the characteristic feed curve (1), and in a third portion (III) drops.

10. In a common rail fuel system, a method of supplying a high pressure pump with a supply of fuel from a prefeed pump, said supply fuel being used in the high pressure pump as a lubricating medium, the method comprising:

providing a flow regulating valve assembly which regulates the flow of the fuel from a flow with a substantially linear characteristic feed curve (1) having a certain slope, the flow regulating valve assembly for the lubricant flow has a characteristic flow curve (2) which initially rises in a first portion (I) with the same slope as the characteristic feed curve (1), then in a second portion (II) rises substantially linearly, but with a lesser slope than the characteristic feed curve (1), and in a third portion (III) drops.

* * * * *